US005385627A

United States Patent [19]

Weimer

[11] Patent Number: 5,385,627

[45] Date of Patent: Jan. 31, 1995

[54] MAILING MACHINE INCLUDING MAILPIECE GUIDING APPARATUS

[75] Inventor: Charles M. Weimer, Norwalk, Conn.

[73] Assignee: Pitney Bowes Inc., Stamford, Conn.

[21] Appl. No.: 616,962

[22] Filed: Nov. 21, 1990

[51] Int. Cl.[6] ..... B43M 3/00

[52] U.S. Cl. ..... 156/441.5; 156/442.1; 156/442.2; 53/226.1; 493/245; 493/260

[58] Field of Search ..... 156/441.5, 442.1, 442.2, 156/442.3, 442.4; 53/266 A; 493/260, 244, 245

[56] References Cited

U.S. PATENT DOCUMENTS 2,302,261 11/1942 Ryan ..... 156/441.5 X 4,450,037 5/1984 Gavronsky ..... 156/442.2 X

*Primary Examiner*—David A. Simmons

*Attorney, Agent, or Firm*—Melvin J. Scolnick; Steven J. Shapiro

[57] ABSTRACT

In a machine for processing a mailpiece, wherein the machine includes an elongate horizontally-extending deck, the machine includes structure for feeding a mailpiece in a downstream path of travel on the deck, the machine includes an upright mailpiece registration wall extending downstream alongside of the deck, and the machine includes a stripper blade horizontally aligned with the deck for operational engagement with a mailpiece fed thereto, an improvement for guiding a mailpiece out of operational engagement with the stripper blade, the improvement including: the deck including a horizontally-extending upstream portion; and an elongate mailpiece guide wall extending laterally from the registration wall and overhanging the upstream portion of the deck; the guide wall having an upstream edge and a downstream edge, the guide wall inclined downwardly from the upstream to the downstream edge thereof and forming an angle of substantially ten to twenty five degrees with respect to the upstream portion off the deck, and the downstream edge of the guide wall overhanging the stripper blade.

7 Claims, 2 Drawing Sheets

MAILING MACHINE INCLUDING MAILPIECE GUIDING APPARATUS

BACKGROUND OF THE INVENTION

The present invention is generally concerned with a mailing machine including mailpiece guiding apparatus and more particularly with apparatus for guiding mailpiece into or out of operational engagement with envelope flap moistening structure.

As shown in U.S. Pat. No. 4,926,787 for Envelope Flap Moistening Apparatus, issued May 22, 1990 to Fassman et al, it is known in the art to provide a mailing machine which includes structure for deflecting the flap of a moving envelope away from the envelope's body and into engagement with a pad which moistens the gummed inner surface of the flap. And, it is known to provide a mailing machine with a trip lever which is actuated by the moving envelope, when the envelope is manually led into engagement therewith, for causing the machine to print postage indicia on the envelope's body, and seal the moistened flap to the body, while mechanically feeding the envelope through the machine.

Thus the mailing machine is adapted for deflecting, moistening and sealing an envelope flap as well as printing postage indicia on the sealed envelope. On the other hand, from time-to-time it is desirable to utilize the machine for postage printing purposes only. For example, to have postage printed on an envelope which is to be used as a returnable mailpiece inserted into another mailpiece, or to have postage printed on a postcard, letter or sheet or other mailpiece. And, due to the mailing machine being adapted to facilitate flap deflection and moistening, mailpieces cannot be readily manually fed to the machine in a manner which bypasses the flap deflecting and moistening functions. Accordingly:

An object of the invention is to provide an improved mailing machine;

Another object is to provide a mailing machine including mailpiece guiding apparatus; and Another object is to provide a mailing machine including apparatus for guiding mailpieces into or out of operational engagement with envelope flap deflecting and moistening structures.

SUMMARY OF THE INVENTION

In a machine for processing a mailpiece, wherein the machine includes an elongate horizontally-extending deck, the machine includes means for feeding a mailpiece in a downstream path of travel on the deck, the machine includes an upright mailpiece registration wall extending downstream alongside of the deck, and the machine includes a stripper blade horizontally aligned with the deck for operational engagement with a mailpiece fed thereto, an improvement for guiding a mailpiece out of operational engagement with the stripper blade, the improvement comprising: the deck including a horizontally-extending upstream portion; and an elongate mailpiece guide wall extending laterally from the registration wall and overhanging the upstream portion of the deck, the guide wall having an upstream edge and a downstream edge, the guide wall inclined downwardly from the upstream to the downstream edge thereof and forming an angle of substantially ten to twenty five degrees with respect to the upstream portion of the deck, and the downstream edge of the guide wall overhanging the stripper blade.

BRIEF DESCRIPTION OF THE DRAWINGS

As shown in the drawings wherein like reference numerals designate like or corresponding parts throughout the several views.

DESCRIPTION OF THE PREFERRED EMBODIMENTS

Figure 1:
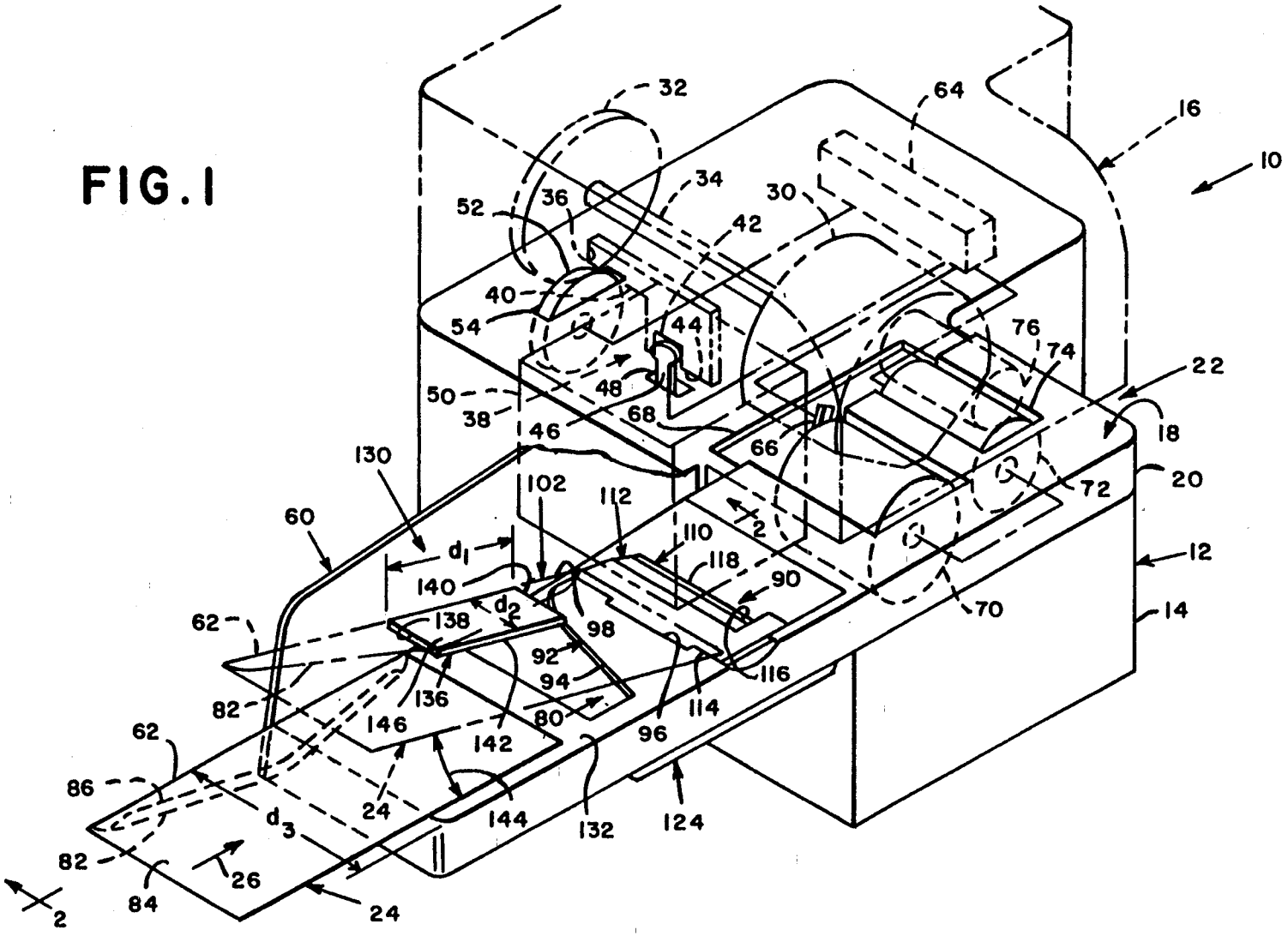
FIG. 1 is a partially phantom, perspective, view of a mailing machine, including a postage meter removably mounted on a base, showing envelope flap deflecting structure and apparatus for guiding mailpieces into or out of engagement therewith.

As shown in FIG. 1, the apparatus in which the invention may be incorporated generally comprises a mailing machine 10 which includes a base 12, having a housing 14, and includes a postage meter 16 which is removably mounted on the base 12. The housing 14 includes an elongate, generally rectangularly-shaped feed deck 18 and includes a front skirt wall 20 which depends from the deck 18. When mounted on the base 12, the postage meter 16 overhangs the deck 18 and forms therewith a slot 22 through which mailpieces 24, such as letters, envelopes or cards, or other sheet-like materials, may be fed in a downstream path of travel 26 on the deck 18.

The postage meter 16 (FIG. 1) generally comprises rotary printing structure including a postage data printing drum 30 and a drive gear 32 therefor. The drum 30 and drive gear 32 are spaced apart from one another and mounted on a common drive shaft 34. The drum 30 is conventionally constructed and arranged for feeding respective mailpieces 24 in the path of travel 26, which extends beneath the drum 30, and for printing postage data, including a serial number, postage value or registration data, alone or in combination with one another, or other selected indicia, on the upwardly disposed surface of each mailpiece 24. The drum drive gear 32 has a key slot 36 formed therein, which is located vertically beneath the drum drive shaft 34 when the drum 30 and drive gear 32 are located in their respective home positions. The postage meter 16 additionally includes a drive gear locking member 38 known in the art as a shutter bar. The shutter bar 38 includes an elongate key portion 40 which is transversely dimensioned to fit into the drive gear's key slot 36. The shutter bar 38 is conventionally reciprocally mounted within the postage meter 16 for movement toward and away from the drum drive gear 32, to permit moving the shutter bar's key portion 40 into and out of the key slot 36, under the control of the mailing machine's base 12, when the drum drive gear 32 is located in its home position. To that end, the shutter bar 38 has a channel 42 formed thereinto from its lower surface 44, and, the mailing machine's base 12 includes a movable lever arm 46, which extends upwardly through an aperture 48, formed in the housing 14. When the meter 16 is mounted on the base 12, the lever arm 46 fits into the channel 42 in bearing engagement with the shutter bar 38 for reciprocally moving the bar's key portion 40 into and out of locking engagement with the drum drive gear 32. And, for driving the lever arm 46 and drum gear 32, the base 12 includes a drive system 50. The drive system 50 includes an output gear 52 which extends upwardly through another housing aperture 54 and into meshing engagement with the drum gear 32. And the drive system 50 is conventionally constructed and arranged for timely moving the lever arm 46 and rotating the output gear 52.

The base 12 (FIG. 1) additionally includes an upright mailpiece registration wall 60, known in the art as a registration fence. Preferably, the fence 60 is integrally formed with the housing 14, such that the fence 60 extends vertically upwardly from the feed deck 18 and is aligned with the path of travel 26, to permit an edge 62 of a given mailpiece 24 to be urged against the fence 60 for aligning the mailpiece 24 with the path of travel 26 when the mailpiece 24 is manually fed to the feed deck 18. Further, the base 12 includes drive system trip structure 64 for sensing mailpieces 24 fed to the machine 10. The trip structure 64 is conventionally connected to the drive system 50 and includes a movable trip lever 66 which extends upwardly through another housing aperture 68 and into the path of travel 26 to permit each mailpiece 24 fed downstream beneath the drum 30 to engage and move the lever 66. Moreover, the base 12 includes a conventional input feed roller 70, known in the art as an impression roller. The impression roller 70 is conventionally connected to the drive system 50 and yieldably mounted to extend upwardly through the housing aperture 68 and into the path of travel 26 for urging each mailpiece ° 24 into printing engagement with the drum 30 and cooperating therewith for feeding the mailpieces 24 through the machine 10.

For feeding sheets 24 (FIG. 1) from the mailing machine 10, the base 12 includes a conventional output feed roller 72, known in the art as an ejection roller. The ejection roller 72 is conventionally connected to the drive system 50, and extends upwardly through a further housing aperture 74 and into the path of travel 26. Moreover, the postage meter 16 includes a suitable idler roller 76 which is conventionally yieldable mounted to extend downwardly into the path of travel 26 and cooperate with the ejection roller 72 for feeding mailpieces 24 from the machine 10.

The mailing machine 10 (FIG. 1) also includes conventional structure 80 for deflecting a flap 82 of an open envelope 24, downwardly from the envelope's body 84, to expose for moistening purposes the gummed, adhesive, strip of material 86 which i conventionally affixed to the interior surface of the envelope flap 82. In addition, the mailing machine 10 includes conventional flap moistening apparatus 90.

Figure 2:
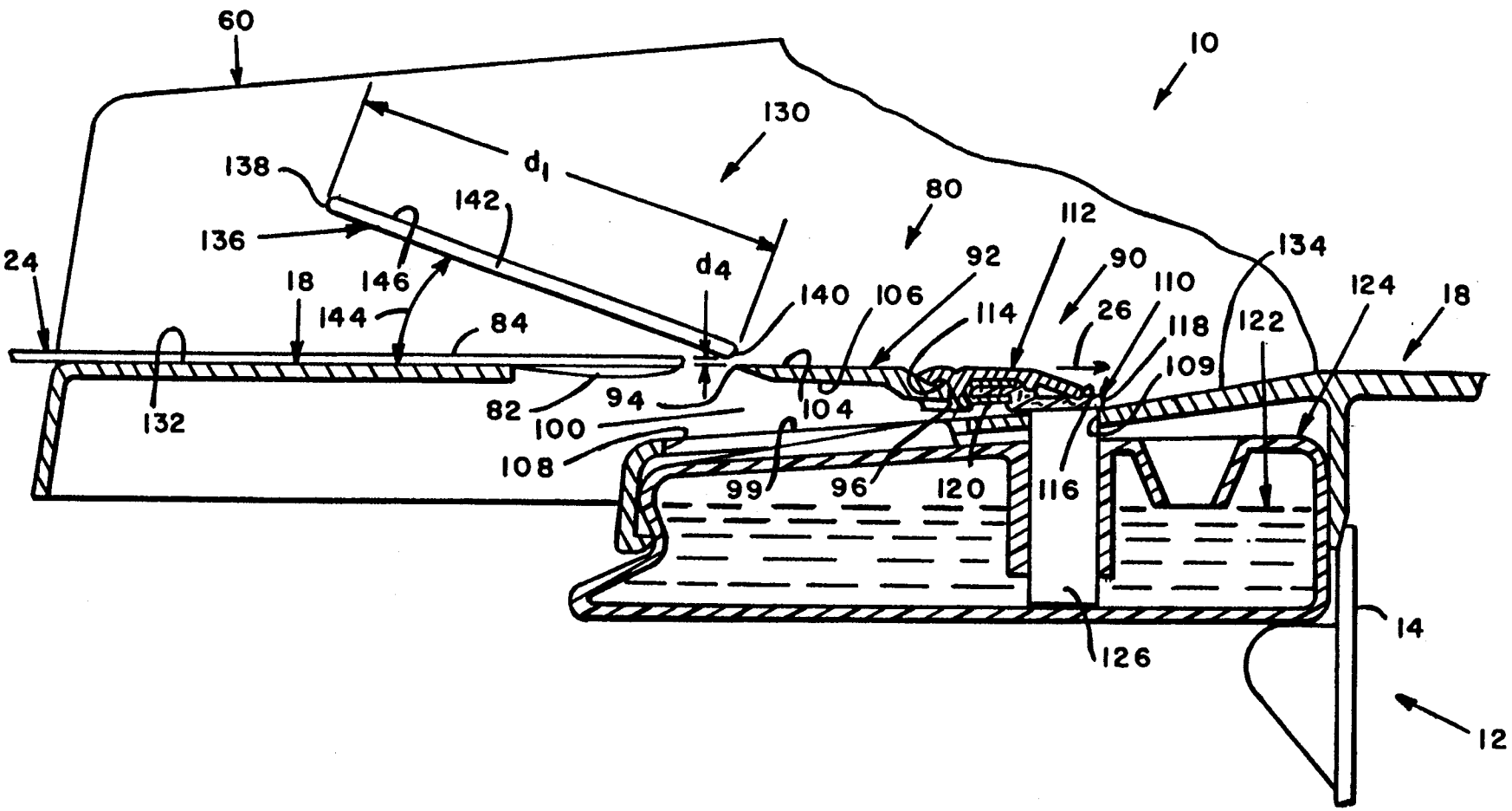
FIG. 2 is a section of FIG. 1, taken substantially along the line 2—2 thereof, showing the envelope flap deflecting and mailpiece guiding structure.

The flap deflecting structure 80 (FIG. 1) includes an elongate, blade-shaped arm 92 which is known in the art as a stripper blade. The stripper blade 92 has an elongate, knife-like, leading edge 94 and an elongate trailing edge 96, and has a side edge 98 which extends between the leading and trailing edges, 94 and 96. The stripper blade 92 is integrally formed with housing's front skirt wall 20 and horizontally-extends downstream in alignment with the deck 18 and towards the registration fence 60, for disposing the stripper blade's leading and trailing edges, 94 and 96, transverse to the direction of the path of travel 26 and for disposing the stripper blade's side edge 98 in facing relationship with the registration fence 60. In addition, the flap deflecting structure 80 includes an envelope flap guide wall 99 (FIG. 2), beneath the stripper blade 92, which is inclined upwardly, in the direction of the path of travel 26. As thus constructed and arranged, the stripper blade 92 overhangs the flap guide wall 99 and defines a channel 100 between the stripper blade 92 and flap guide wall 99. In addition, the stripper blade 92 defines an elongate gap 102 (FIG. 1) between the stripper blade's side edge 98 and the registration fence 60, which extends in the direction of the path of travel 26. Further, the stripper blade 92 has a horizontally-extending upper surface 104 on which the body 84 of an envelope 24 is supported when fed to the machine 10, and has a lower surface 106 (FIG. 2). Moreover, the flap guide wall 99 has an opening 108 formed therein to accommodate integrally molding the stripper blade 92 therewith, and includes a transversely extending row of apertures 109, one of which is shown, which are known in the art as windows. The windows 109 are located downstream from the stripper blades trailing edge 96.

The flap moistening apparatus 90 (FIG. 1) generally includes a conventional moistening fluid applicator 110 (FIG. 2), and an applicator retainer 112 to which the applicator 110 is conventionally removably attached. The retainer 112 has a transversely extending leading edge 114, which is conventionally adapted to be removably attached to the stripper blade's trailing edge 96, and has a trailing edge 116. In addition, the applicator 110 includes an elongate pad 118 and base portion 120. The base portion 120, or ferrule, is U-shaped in traverse cross-section and is dimensioned for receiving therein an elongate marginal edge portion of the pad 118. Preferably, the pad 118 is made of a flexible, feint-like material, such as a woven or spun bundle of natural or man-made fibers, or other material which is constructed and arranged to act as a wick for drawing fluid 122 by capillary action from a conventional fluid supply 124, equipped with a comparable conventional supply pad 126, via the flap guide wall windows 109 for moistening the pad 118. To that end, the applicator pad 118 is dimensioned to extend downwardly from the ferrule 120, toward the inclined flap guide wall 99, downstream beneath the retainer's trailing edge 96, and into overlying relationship with the deck windows 109 when the retainer 112 is connected to the stripper blade 92.

A more detailed discussion of the flap deflecting structure 80 (FIG. 1), flap moistening apparatus 90 and fluid supply 124 may be found in the aforesaid U.S. Pat. No. 4,926,787.

In operation, an open envelope 24 (FIG. 1) is ordinarily manually fed to the upper surface 104 of the stripper blade 92 in a manner such that the envelope's edge 62 is initially urged into engagement with the registration fence 60. And, as the envelope is moved downstream in the direction of the path of travel 26, the envelope's flap 82 is urged into operational engagement with the stripper blade 92. In particular, as the envelope 24 is progressively moved downstream, the stripper blade's leading edge 94 separates and downwardly deflects the envelope's flap 82 from the envelope's body 84. Whereupon the envelope's body 84 is fed downstream on the stripper blade's upper surface 104 as the stripper blade's lower surfaces 106 (FIG. 2) guides the flap 92 into the gap 102 (FIG. 1) and downwardly into the channel 100 (FIG. 2), beneath the stripper blade 92. As a result, the gummed strip of material 86, affixed to the interior of the envelope flap 82, is faced upwardly within the channel 100 and is exposed for moistening purposes. As the envelope 24 is progressively moved downstream, the flap 82 engages the upwardly inclined flap guide wall 99 and is guided upwardly thereby beneath the stripper blade's trailing edge 96, and then beneath the retainer 90 and moisture applicator pad 118. As the envelope flap 82 is fed beneath the pad 118, moisture from the pad 118 is transferred to the flap's gummed strip of material 86. As the envelope 24 is fed still further downstream, in the direction of the path of travel 26, the envelope 24 engages and moves the trip lever 66 (FIG. 1), causing the drive system 50 to be actuated. Whereupon the drive system 50 causes the lever arm 46 to move the shutter bar 38 out of locking engagement with the drum drive gear 32 and commences rotating the output drive gear 52, and thus the drum drive gear 32, shaft 34, postage meter drum 30 and impression roller 70, and commences rotating the ejection roller 62, in timed relationship with one another for feeding the envelope 24 through and from the machine 10. As the envelope 24 is fed through the machine 10, the drum 30 prints indicia on the envelope body 84. And, as the postage meter drum 30 and impression roller 70, and thereafter the postage meter idler roller 76 and ejection roller 72, rotate in engagement with the envelope 24, the pressure exerted thereby against the envelope flap 82 and, in particular, against that portion of the flap 82 which includes the gummed strip of material 86, causes the moistened, gummed strip of material 86 to seal the envelope's flap 82 to the envelope's body 84.

According to the invention, the mailing machine 10 (FIG. 1) includes apparatus 130 for guiding respective mailpieces 24 out of operational engagement with the flap deflecting structure 80, and, more particularly, into overlying relationship with the stripper blade 92. To that end, the deck 18 is preferably extended to include a horizontally-extending upstream portion 132, which is horizontally aligned with the stripper blade's upper surface 104. Thus the flap guide wall 99 (FIG. 2) extends upwardly from beneath the level of the deck's upstream portion 132. In addition, the mailpiece registration wall 60 is preferably extended upstream alongside of the deck's upstream portion 132.

The mailpiece guiding apparatus (FIG. 1) additionally includes an elongated, preferably rectangularly-shaped, mailpiece guide wall 136, which laterally extends from the registration wall 60 and into overhanging relationship with respect to the upstream portion 132 of the deck 18. The guide wall 136 is preferably integrally molded with the registration wall 60. Moreover, the walls, 60 and 136, are preferably integrally made of a resilient plastic material such as polycarbonate. The guide wall 136 has an upstream edge 138 and a downstream edge 140, and has a free edge 142 extending between the upstream and downstream edges, 138 and 140. And the guide wall 136 is inclined downwardly from the upstream edge 138 to the downstream edge 140, so as to from an acute angle 144 (FIG. 2) of substantially ten to twenty five degrees with respect the upstream portion 132 of the deck 18. Preferably, the longitudinal length dimension "$d_1$" of the guide wall 136, as measured between the upstream and downstream edges 138 and 140, is not more than eight inches, to facilitate registration of longitudinally extending edges 62 (FIG. 1) of the largest mailpieces 24 processed by the machine 10. And, the width dimension "$d_2$" of the guide wall 136, as measured between the registration wall 60 and the guide wall's free edge 142, is preferably not more than one half of the width dimension "$d_3$" of the deck 18, to facilitate line of sight viewing of mailpieces 24 fed therebeneath. Preferably, the guide wall's downstream edge 140 (FIG. 2) overhangs the stripper blade 92, and, more particularly, overhangs the leading edges 94 thereof. Moreover, as shown in FIG. 2, the downstream edge 140 is preferably spaced a predetermined distance "$d_4$" of not more than twenty-thousandth of an inch above the stripper blade's leading edge 94, to accommodate feeding therebetween stuffed mailpieces 24.

In operation, assuming a given mailpiece 24 (FIG. 1), such as an open envelope, sealed envelope, postcard, letter, or the like, is to be fed to the mailing machine 10 for processing thereby without utilizing the functions of the flap deflecting and moistening structures, 80 and 90, the mailpiece 24 may be initially manually located in place on the upper surface 146 of the guide wall 136, as shown in the phantom portrayal of the envelope 24, and then slidably moved downwardly thereon while urging the mailpiece's edge 62 into registration with the upright registration fence 60. Whereupon, the mailpiece 24 is progressively moved downwardly and into engagement with the upper surface 104 of the stripper blade, and slidably downstream thereon, over the retainer 112 and pad 110, and into engagement with the trip lever 66 for actuating he drive system 50 of the machine 10, as hereinbefore discussed, to feed the mailpiece 24 therethrough as the drum 30 prints postage indicia thereon.

In addition, assuming a mailpiece 24 (FIGS. 1 and 2) is fed beneath the guide wall 136, the lower end of the guide wall 136 tends to deflect and guide the mailpiece 24 toward the stripper blade 94. Moreover, as a stuffed mailpiece 24, having a thickness dimension which is more than the distance "$d_4$" between guide wall's downstream edge 140 and the stripper blade's leading edge 94, is fed between the edges, 140 and 94, due to the guide wall 136 being made of a resilient plastic material, the mailpiece's body 84 is fed therebetween against the downwardly directed resilient force exerted by the lower edge 140 of the guide wall 136 on the envelope's body 84, which force tends to urge an envelope's flap 82 beneath the stripper blade's leading edge 94. Accordingly, provision of mailpiece guiding apparatus 130 facilitates the guidance of mailpieces 24 into operational engagement with the flap deflecting structure 80 as well as facilitating the guidance of mailpieces 24 out of operational engagement therewith.

In accordance with the objects of the invention there has been described an improved mailing machine including mailpiece guiding structure for facilitating guiding mailpieces into or out of operational engagement with flap deflecting structure.

Inasmuch as certain changes may be made in the above described invention(s) without departing from the spirit and scope of the same, it is intended that all matter contained in the above description or shown in the accompanying drawings shall be interpreted in an illustrative rather than limiting sense. And, it is intended that the following claims be interpreted to cover all the generic and specific features of the invention(s) herein described.

What is claimed is:

1. In a machine for processing a mailpiece, wherein the machine includes an elongate horizontally-extending deck, the machine includes means for feeding a mailpiece in a downstream path of travel on the deck, the machine includes an upright registration wall extending downstream alongside of the deck, and the machine includes a stripper blade horizontally aligned with the deck for operational engagement with a mailpiece fed thereto, an improvement for guiding a mailpiece out of operational engagement with the stripper blade, the improvement comprising:

a. the deck including a horizontally-extending upstream portion; and b. an elongate mailpiece guide wall for guiding a mailpiece out of operational engagement with the stripper blade, the guide wall extending laterally from the registration wall and overhanging the upstream portion of the deck, the guide wall having an upstream edge and a downstream edge, the guide wall inclined downwardly from the upstream to the downstream edge thereof and forming an angle of substantially ten to twenty five degrees with respect to the upstream portion of the deck, and the downstream edge of the guide wall overhanging and spaced a predetermined distance above the stripper blade.

2. The improvement according to claim 1, wherein the guide wall and upright wall are integrally molded.

3. The improvement according to claim 1, wherein the deck has a predetermined width dimension, and the guide wall in generally rectangularly-shaped and has a width dimension of not more than one half the width dimension of the deck.

4. The improvement according to claim 2, wherein the predetermined distance is not more than twenty thousandth of an inch.

5. The improvement according to claim 2, wherein the guide wall and upright wall are made of a resilient plastic material.

6. The improvement according to claim 3, wherein the downstream edge of the guide wall is spaced not more than twenty thousandth of an inch above the stripper blade.

7. The improvement according to claim 6, wherein the guide wall and upright wall are integrally made of a resilient plastic material.

* * * * *